US006945749B2

(12) United States Patent
De Cardenas

(10) Patent No.: US 6,945,749 B2
(45) Date of Patent: Sep. 20, 2005

(54) TURBINE BLADE PLATFORM COOLING SYSTEM

(75) Inventor: Rafael De Cardenas, Orlando, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/661,688

(22) Filed: Sep. 12, 2003

(65) Prior Publication Data

US 2005/0058545 A1 Mar. 17, 2005

(51) Int. Cl.[7] ..... F01D 5/08
(52) U.S. Cl. ..... 415/115; 416/97 R; 416/193 A
(58) Field of Search ..... 415/115; 416/97 R, 416/193 A

(56) References Cited

U.S. PATENT DOCUMENTS

| | | | | |
|---|---|---|---|---|
| 2,656,147 A | * | 10/1953 | Brownhill et al. | 416/97 R |
| 5,344,283 A | | 9/1994 | Magowan et al. | |
| 5,382,135 A | | 1/1995 | Green | |
| 5,639,216 A | * | 6/1997 | McLaurin et al. | 416/95 |
| 5,848,876 A | | 12/1998 | Tomita | |
| 6,071,075 A | * | 6/2000 | Tomita et al. | 416/97 R |
| 6,082,961 A | | 7/2000 | Anderson et al. | |
| 6,120,249 A | | 9/2000 | Hultgren et al. | |
| 6,132,173 A | | 10/2000 | Tomita et al. | |
| 6,190,130 B1 | | 2/2001 | Fukue et al. | |
| 6,196,799 B1 | | 3/2001 | Fukue et al. | |
| 6,210,111 B1 | | 4/2001 | Liang | |
| 6,254,333 B1 | | 7/2001 | Merry | |
| 6,309,175 B1 | | 10/2001 | Hahnle et al. | |
| 6,402,471 B1 | | 6/2002 | Demers et al. | |
| 6,431,833 B2 | | 8/2002 | Jones | |
| 6,478,540 B2 | | 11/2002 | Abuaf et al. | |
| 6,506,020 B2 | | 1/2003 | Dailey | |
| 6,508,620 B2 | | 1/2003 | Sreekanth et al. | |
| 2002/0076324 A1 | | 6/2002 | Abuaf et al. | |
| 2002/0090295 A1 | | 7/2002 | Torii et al. | |
| 2002/0098078 A1 | | 7/2002 | Beeck et al. | |

* cited by examiner

*Primary Examiner*—Edward K. Look
*Assistant Examiner*—Igor Kershteyn

(57) ABSTRACT

Aspects of the invention relate to a cooling system for a blade platform that can provide cooling to and reduce stress on the platform. Aspects of the invention relate to including one or more channels in the blade platform such that the channels extend from the trailing edge face of the platform toward, but terminate prior to, the leading edge face of the platform. The channels can be generally oval or oblong in conformation. Extending between the hollow shank and the channels can be a plurality of cooling holes. During engine operation, coolant is supplied to the shank of the blade assembly. Because the pressure at the shank is greater than the pressure at the trailing edge of the platform, coolant flow is induced through the cooling holes and into the channels. After flowing through the channels, the coolant can be dumped at the trailing edge.

16 Claims, 9 Drawing Sheets

TURBINE BLADE PLATFORM COOLING SYSTEM

FIELD OF THE INVENTION

The invention relates in general to turbine engines and, more particularly, to a system for cooling the platform of a turbine blade.

BACKGROUND OF THE INVENTION

Various components in the turbine section of a turbine engine, including the rotating turbine blades, are subjected to extremely high temperatures, which can impart thermal stresses on such components. With respect to turbine blades, thermal stress is a function of temperature gradients as well as the structural stiffness of the blade. Exposure to high temperatures and thermal stresses can result in the turbine blades having low fatigue lives, which commonly manifest as cracks in the blade platform.

SUMMARY OF THE INVENTION

Thus, one object according to aspects of the present invention is to improve the fatigue life of turbines blades by reducing temperature and stress in the platform. Another object according to aspects of the present invention is to configure a blade platform so as to facilitate coolant flow while also reducing the structural stiffness of the platform. One more object according to aspects of the invention is to use impingement cooling to substantially evenly reduce metal temperatures and thermal gradients in the blade platform. An additional object according to the invention is to employ the pressure differentials existing between various portions of the blade so as to induce cooling flow. Still another object according to aspects of the present invention is to provide a blade platform having an integrated cooling system so as to avoid the need for additional parts and/or subsequent assembly steps. A further object according to aspects of the present invention is to provide cooling to the leading and trailing edge sides of the platform. Objects according to aspects of the present invention also relate to a method for cooling a turbine blade platform.

Aspects of the invention relate to a turbine blade assembly. The blade assembly includes a platform, an airfoil portion, and a hollow shank portion. The platform has a leading edge face, a trailing edge face, a first side and a second side. The airfoil portion extends from the platform, and the hollow shank portion is disposed beneath the platform. A cooling channel extends through the platform, beginning in an area near the leading edge face and extending through the trailing edge face of the platform. The cooling channel extends substantially proximate to the first side of the platform. A plurality of cooling holes extend between the hollow shank portion and the cooling channel. The cooling holes are oriented substantially transverse to the cooling channel. The cooling holes can be substantially circular in cross-section.

The cooling channel can be substantially oval shaped or it can be substantially oblong shaped. In one embodiment, the cooling channel can have substantially rounded corners. Further, the cooling channel can include a substantially flat upper wall and a substantially flat lower wall. The upper and lower walls can be substantially parallel.

The blade assembly can further include a second cooling channel that extends through the platform, beginning in an area near the leading edge face and extending through the trailing edge face of the platform. The second channel can extend substantially proximate to the second side of the platform. A plurality of cooling holes can extend between the hollow shank portion and the second cooling channel. In addition, the cooling holes can be oriented substantially transverse to the second cooling channel.

Further, the blade assembly can include a branch channel in fluid communication with the cooling channel. The branch channel can include an edge segment and an exhaust segment. The edge segment can extend substantially proximately along at least a portion of the trailing edge face of the platform. In one embodiment, the exhaust segment can extend upward from the edge segment and through a top surface of the platform.

The cooling channel can be partially restricted by a cover, which can be one of a plate or a plug. In one embodiment, the blade assembly can include an additional channel. The cooling channel and the additional channel can be in fluid communication. The additional channel can disposed between the cooling channel and the first side of the platform. In another embodiment, the blade assembly can include one or more passages extending between the cooling channel and one of the sides of the platform. In still another embodiment, the blade assembly can include one or more passages extending between the cooling channel and the top surface of the platform.

Other aspects of the invention relate to a turbine blade assembly having a platform, an airfoil portion extending from the platform, and a hollow shank portion disposed beneath the platform. The platform has a leading edge face, a trailing edge face, a first side and a second side. A first cooling channel extends through the platform, beginning in an area near the leading edge face and extending through the trailing edge face of the platform. The first cooling channel extends substantially proximate to the first side of the platform. A second cooling channel extends through the platform, beginning in an area near the leading edge face and extending through the trailing edge face of the platform. The second cooling channel extends substantially proximate to the second side of the platform. Each of the cooling channels is defined by a substantially flat top surface and substantially flat bottom surface and two curved side walls connecting between the top and bottom surfaces. The top and bottom surfaces are substantially parallel to each other.

A first set of cooling holes extend between the hollow shank portion and the bottom surface of the first cooling channel so as to be oriented substantially transverse to the first cooling channel; a second set of cooling holes extend between the hollow shank portion and the bottom surface of the second cooling channel so as to be oriented substantially transverse to the second cooling channel.

DETAILED DESCRIPTION OF EMBODIMENTS OF THE INVENTION

Aspects of the present invention improve upon prior systems for cooling the platform of a turbine blade. Aspects of the present invention relate to a turbine blade assembly having a platform configured to improve fatigue life of the turbine blade by cooling the platform while also reducing thermal stresses on the platform.

Embodiments of the invention will be explained in the context of one possible turbine blade assembly, but the detailed description is intended only as exemplary. Embodiments of the invention are shown in FIGS. 1–9, but the present invention is not limited to the illustrated structure or application.

Figure 1:
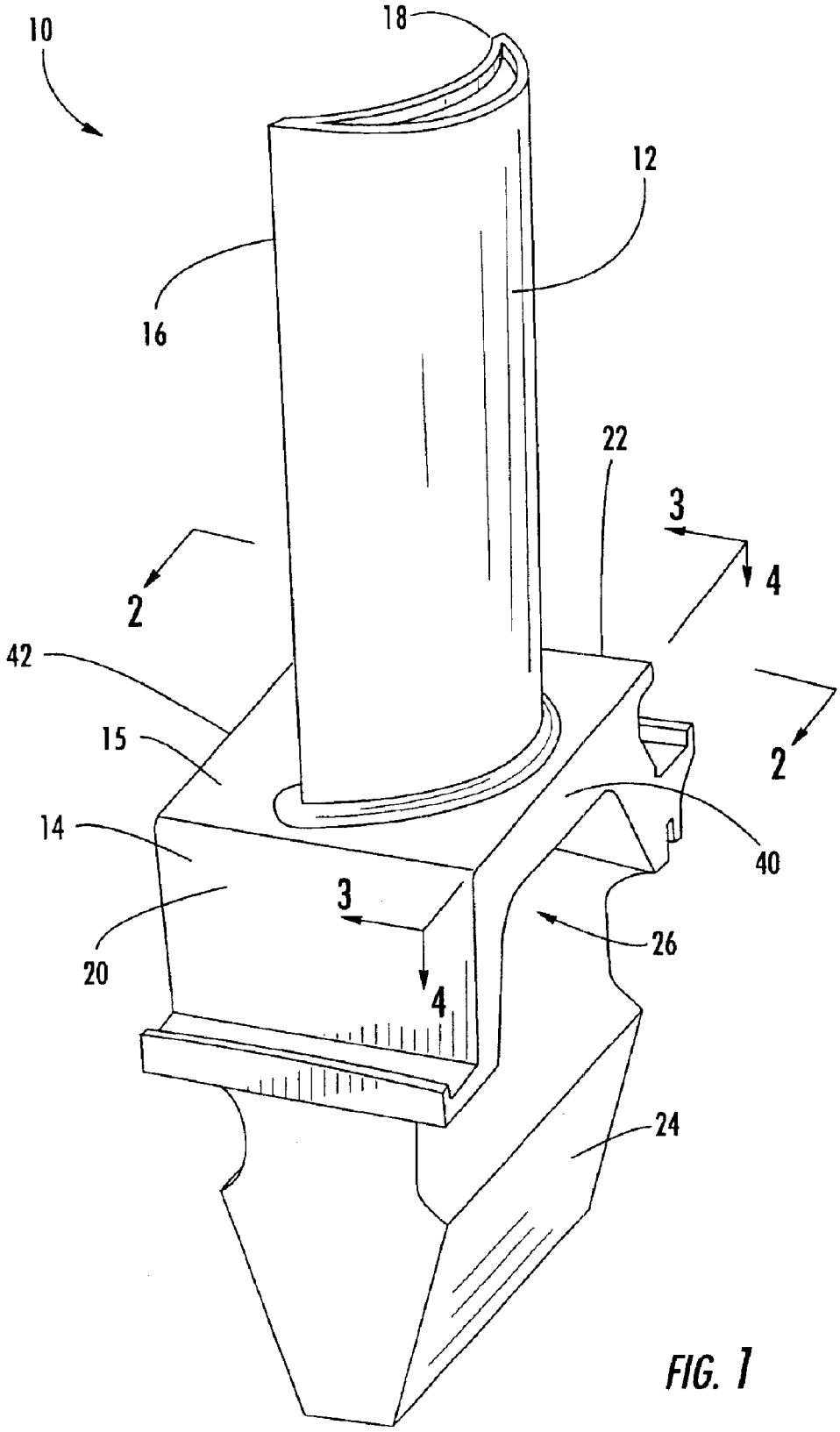
FIG. 1 is an isometric view of a turbine blade assembly according to aspects of the present invention.

One example of a turbine blade assembly 10 is shown in FIG. 1. The turbine blade assembly 10 can include an airfoil portion 12 extending radially away from a platform portion 14. The platform portion can be generally planar, cylindrical or otherwise curved. The airfoil portion 12 can have a leading edge 16 and a trailing edge 18. The leading edge 16 is the edge of the airfoil 12 that generally faces the oncoming combustion gases. Similarly, the platform portion 14 has a leading edge face 20 and a trailing edge face 22. Again, the leading edge face 20 of the platform 14 generally faces the oncoming combustion gases. The blade assembly 10 further includes a root portion 24 that can engage with a groove formed in a disc on a turbine rotor (not shown) so as to secure the blade assembly 10. Beneath the platform 14 but above the root 24 is a generally hollow cavity 26, referred to as a shank.

Figure 2:
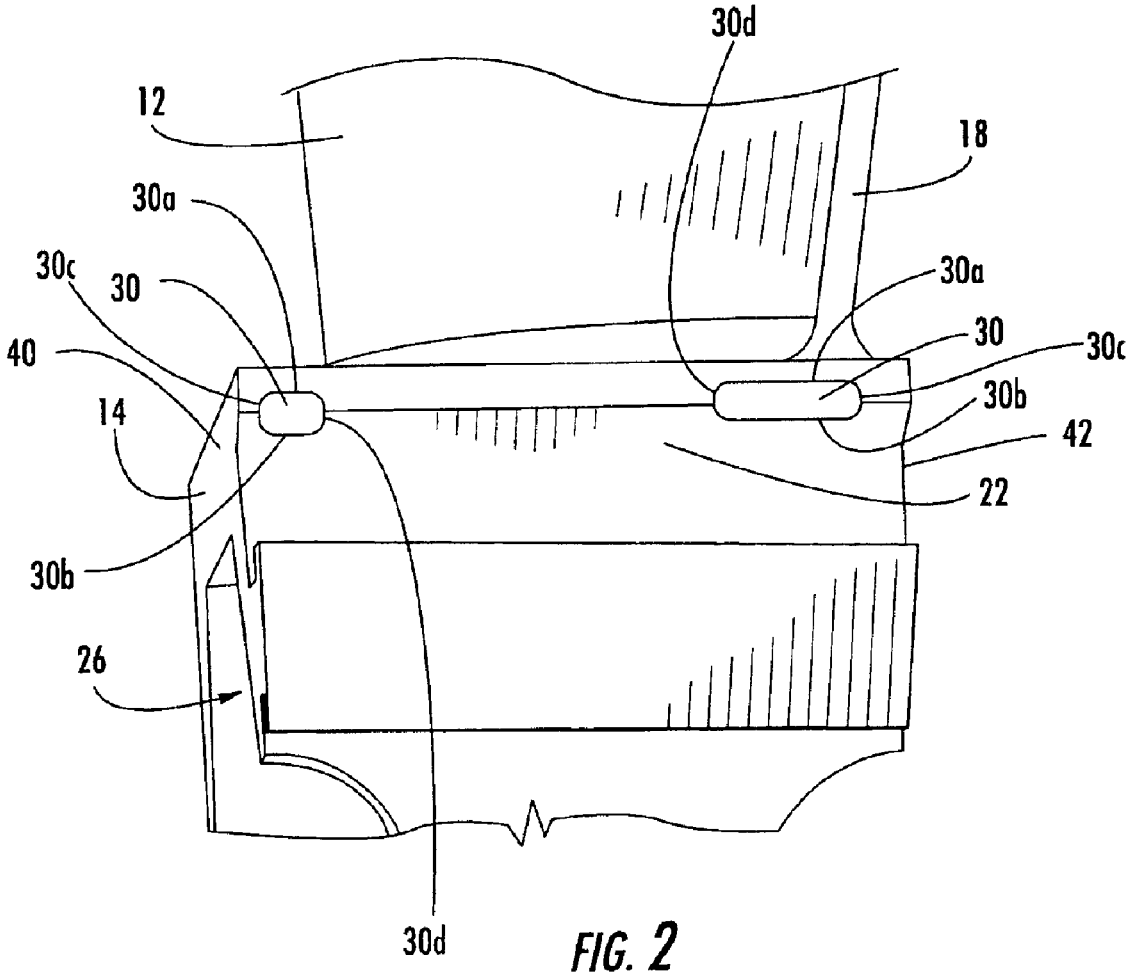
FIG. 2 is an isometric view, along line 2—2 in FIG. 1, of a portion of the trailing edge face of a turbine blade assembly according to aspects of the invention.

As shown in FIG. 2, aspects of the invention relate to one or more cooling channels 30 provided in the platform 14. The channels 30 can extend from the trailing edge face 22 of the platform 14 and into the platform 14 toward the leading edge face 20 of the platform 14. However, the channels 30 do not extend through to the leading edge face 20 of the platform 14, that is, the channels 30 terminate prior to the leading edge face 20.

The channels 30 can have a variety of cross-sectional conformations such as oval or oblong. Preferably, the channels 30 have rounded corners so as to avoid stress concentrations. In one embodiment, each of the channels 30 can be defined by at least a substantially flat top surface and substantially flat bottom surface 30*a*,30*b*. The top and bottom surfaces 30*a*,30*b* can be substantially parallel to each other. Each of the channels 30 can further be defined by two side walls 30*c*,30*d* connecting between the top and bottom surfaces 30*a*,30*b*. Preferably, the side walls 30*c*,30*d* are curved, such as being outwardly bowed, so that the channel 30 has a cross-section that is substantially oval shaped with flattened top and bottom sides. It should be noted that terms like top and bottom used in connection with the surfaces of the channel 30, as well as other relative terms used throughout this disclosure, are merely for facilitating discussion and are not intended to limit the scope of the invention.

In one embodiment, the channels 30 can be slightly tapered such that the channels 30 are relatively narrow in width near the leading edge face 20 of the platform 14 compared to the width of the channels 30 near or at the trailing edge face 22 of the platform 14. In other words, the channels 30 can gradually flare outward as the channel 30 approaches the trailing edge face 22 of the platform 14. Such a configuration can help to reduce cross-flow or choke flow conditions at the exit of the channel 30. The taper can occur along one or both of the top and bottom surfaces 30*a*,30*b* or along one or both of the two side walls 30*c*,30*d* or along any combination of thereof.

When two or more channels 30 are provided, the channels 30 can be substantially identical to each other in terms of size and shape. Alternatively, the two or more channels 30 can be different. Further, the channels 30 can have any of a variety of relationships with respect to each other. For instance, the two channels 30 can be substantially parallel to each other or they may not be substantially parallel.

Figure 5:
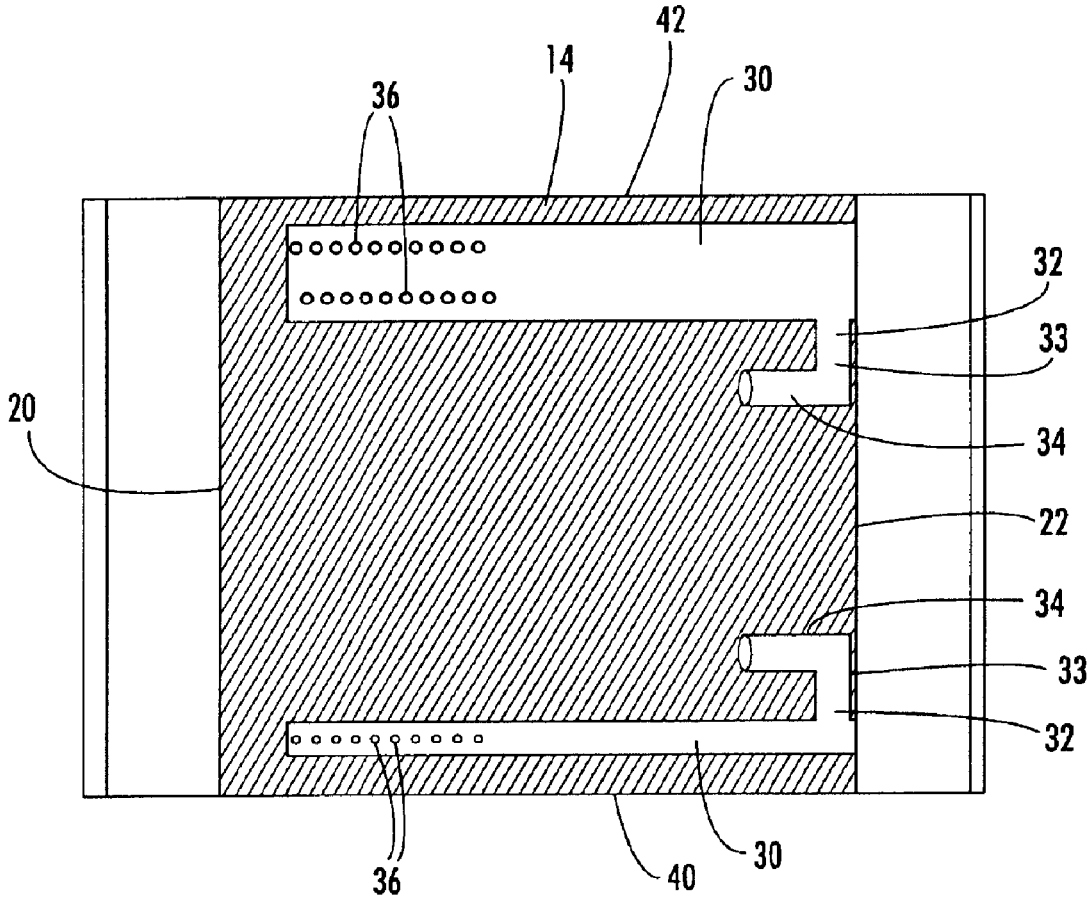
FIG. 5 is a cross-sectional view of a turbine blade platform showing an alternative cooling system according to aspects of the present invention.

Preferably, the channels extend substantially proximate to the sides of the platform 40,42. Thus, the channels 30 can provide cooling to at least those portions of the platform that overhang the shank 26. While the channels 30 can cool portions of the platform 14, cooling the edge portions of the platform 14, especially on the leading and trailing edge faces 20,22, can be challenging. Thus, in one embodiment, aspects according to the present invention can be configured to provide cooling to the trailing edge face 22 of the platform 14. For example, as shown in FIG. 5, the channel 30 can include one or more branch channels 32. Preferably, the branch channel 32 is located near the trailing edge face 22 of the platform 14 not only to provide cooling to the trailing edge face 22 of the platform 14, but also to reduce any pressure buildup near the exit of the channel 30 at the trailing edge face 22. To that end, the branch channel 32 can act as a relief.

Figure 4:
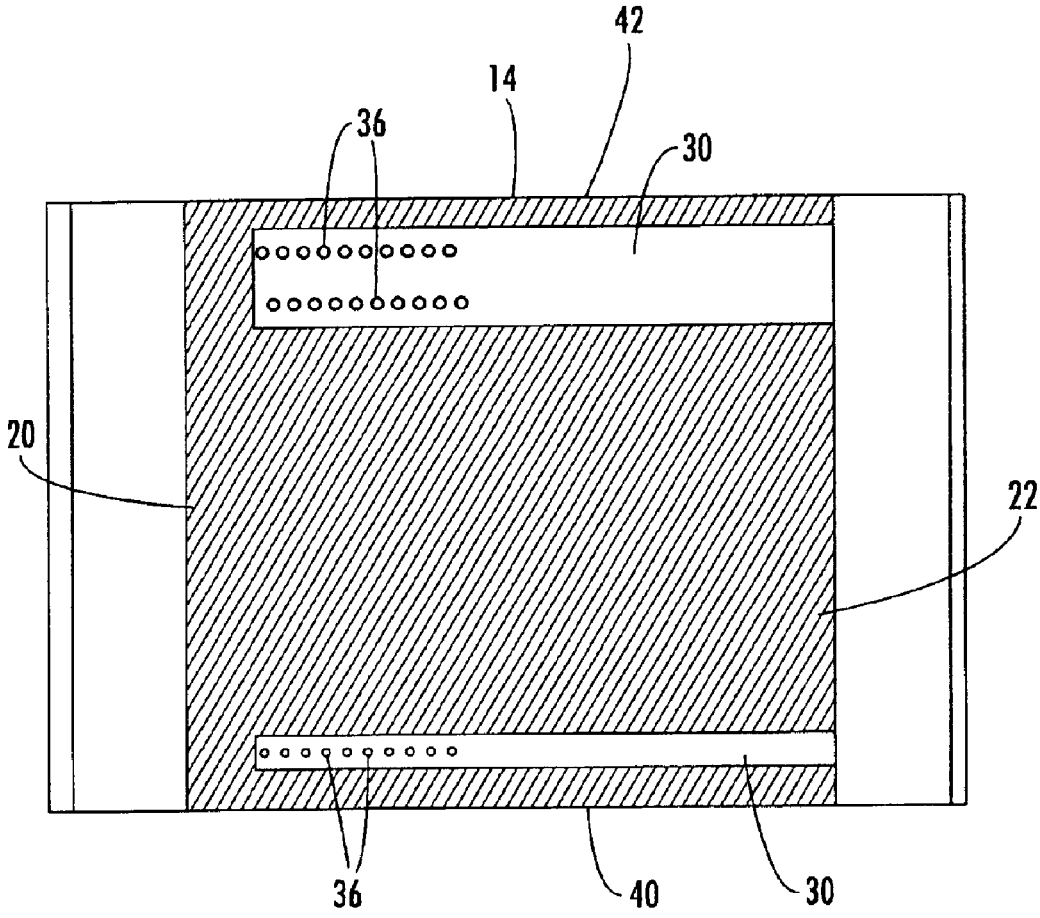
FIG. 4 is a cross-sectional view of a turbine blade platform, taken along line 4—4 in FIG. 1, having a cooling system according to aspects of the present invention.

The branch channel 32 can include an edge segment 33 and an exhaust segment 34. The edge segment 33 of the branch channel 32 can extend substantially proximate to at least a portion of the trailing edge face 22 of the platform 14 as shown in FIG. 4. The edge segment 33 of the branch channel 32 can be located as close to the trailing edge face 22 as possible so as to provide cooling to the trailing edge face 22 of the platform 14. From there, the exhaust segment 34 of the branch channel 32 can extend upwardly. In one embodiment, the exhaust segment 34 can extend upward at substantially 90 degrees relative to edge segment 33; alternatively, the exhaust segment 34 can extend gradually upward from the edge segment 33. These are merely two examples of the path that the exhaust passage can have. Regardless of the specific path of the branch channel 32, the branch channel 32 exits through the top surface 15 of the platform 14 near the trailing edge side 22.

The platform 14 can further include one or more cooling holes 36 extending between the at least one channel 30 to the shank portion 26 of the blade assembly 10. The cooling holes 36 can be extend from the at least one channel 30 at almost any angle relative to the at least one channel 30, but, it is preferred if the cooling holes 36 are oriented substantially transverse to the at least one channel 30. The cooling holes 36 can be provided along the entire length of the at least one channel 30. Ideally, the cooling holes 36 are arranged and situated so as to minimize cross flow of coolant out of the channel 30. Therefore, in one embodiment, the cooling holes 36 can are provided along less than the entire length of the at least one channel 30. For example, the cooling holes 36 may only provided along a portion of the channel 30 closer to the leading edge face 20 of the platform 14, as shown in FIGS. 4–5.

The cooling holes 30 can be arranged according to a pattern or to no particular pattern. In addition, any number of cooling holes 36 can be provided. Further, the size, spacing and quantity of cooling holes can be optimized to direct coolant where necessary and to meet shank pressure requirements. Also, the size and spacing of the cooling holes 36 need not be substantially identical among all the cooling holes 36 provided. The cooling holes 36 can have any of a number of cross-sectional geometries. Preferably, the cooling holes 36 are substantially circular, but the cooling holes 36 can also be, for example, oval, oblong, triangular, polygonal, rectangular, or trapezoidal. In the case of two or more cooling channels 30, the pattern, size, spacing, and geometry of the cooling holes 36 can but need not be identical from one channel 30 with respect to another channel 30.

Figure 6:
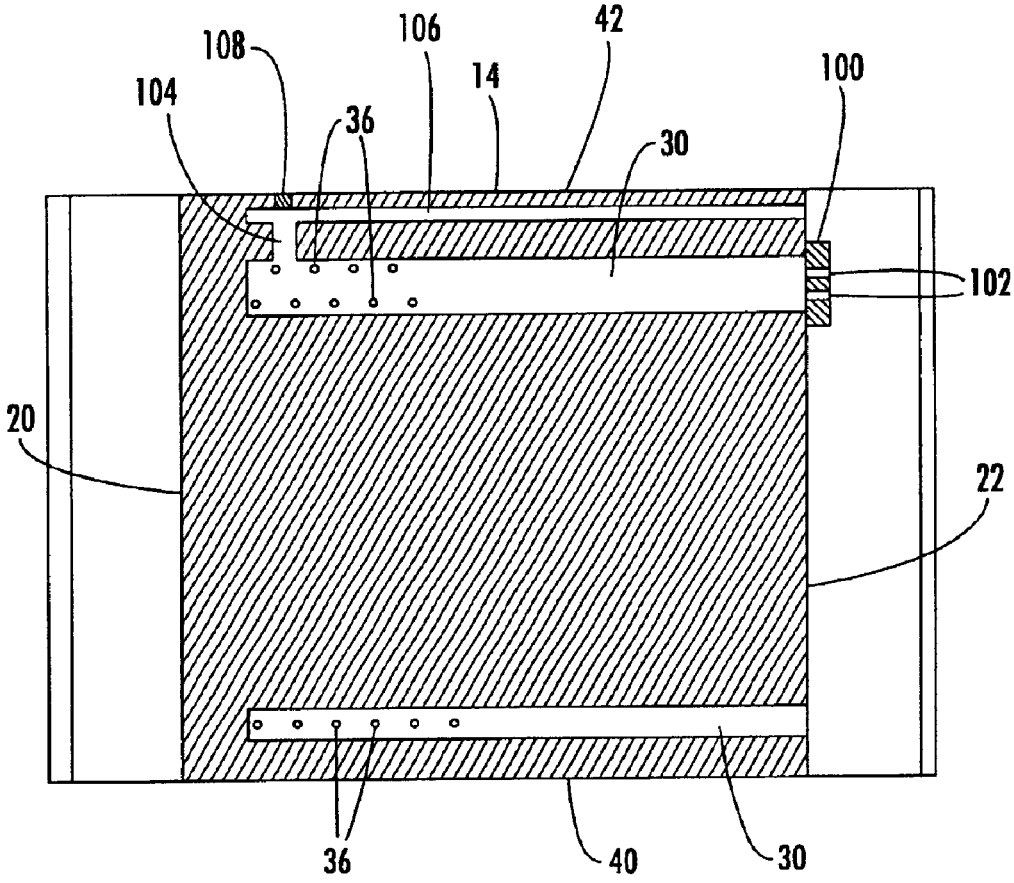
FIG. 6 is a cross-sectional view of a turbine blade platform showing an alternative cooling system according to aspects of the present invention.

Another embodiment according to aspects of the invention is shown in FIG. 6. Here, an additional channel can be provided that runs substantially adjacent to the channel 30 and the side 42 of the platform 14. The additional channel 106 is connected to the channel 30 by passage 104. A cover 100 can be provided placed over, inside or otherwise proximate the trailing edge side exit of the channel 30. The cover 100 can be a plate or a plug including one or more passages 102 to allow at least a portion of the flow to exit the channel 30. The cover 100 can be any device that meters, obstructs or restricts the flow out of the channel 30. As a result, pressure builds in the channel 30 and a portion of the flow can be diverted into passage 104, through the additional channel 106, and ultimately exiting at the trailing edge side 22 of the platform 14. Such a cooling system can reduce cross-flow effects in the channel 30. The additional channel 106 can have any of a number of cross-sectional conformations.

Figure 7:
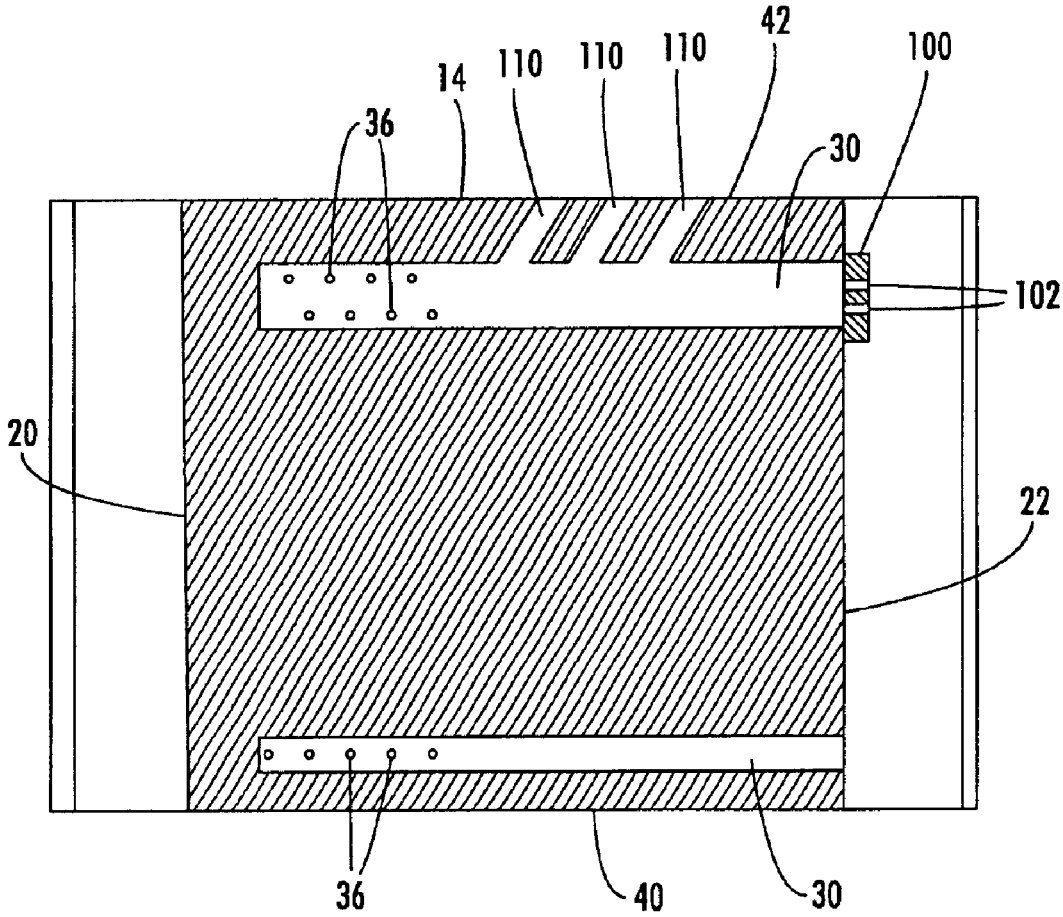
FIG. 7 is a cross-sectional view of a turbine blade platform showing an alternative cooling system according to aspects of the present invention.

Yet another embodiment, shown in FIG. 7, also relates to at least partially blocking the exit of the channel 30 at the trailing edge side 22 using a cover 100 having one or more openings 102 so as to build pressure in the channel 30. In this case, one or more passages 110 are provided that extend between the channel 30 and the side wall 42 of the platform 14. Again, the cover 100 restrict flow out of the channel 30, thereby forcing at least a portion of the flow to exit through passages 110. Preferably, the passages 110 exhaust out of one of the side walls 40,42 of the platform 14 in a low pressure area of the platform 14 so as to avoid the possibility of flow reversal through the passages 110. In instances where more than one channel 30 is provided, one or both of the channels 30 can include the passages 110 according to aspects of the invention.

The passages 110 can be oriented at almost any angle relative to the channel 30 or the side walls 40,42 of the platform 14. For example, the passages 110 can be oriented at substantially right angles to the side wall 42. However, it is preferred if the passages 110 are not oriented at substantially right angles with respect to the side wall so as to gain the additional advantage of film cooling. In one instance, the passages are located at about 60 degrees relative to the channel 30 in the platform.

Figure 8:
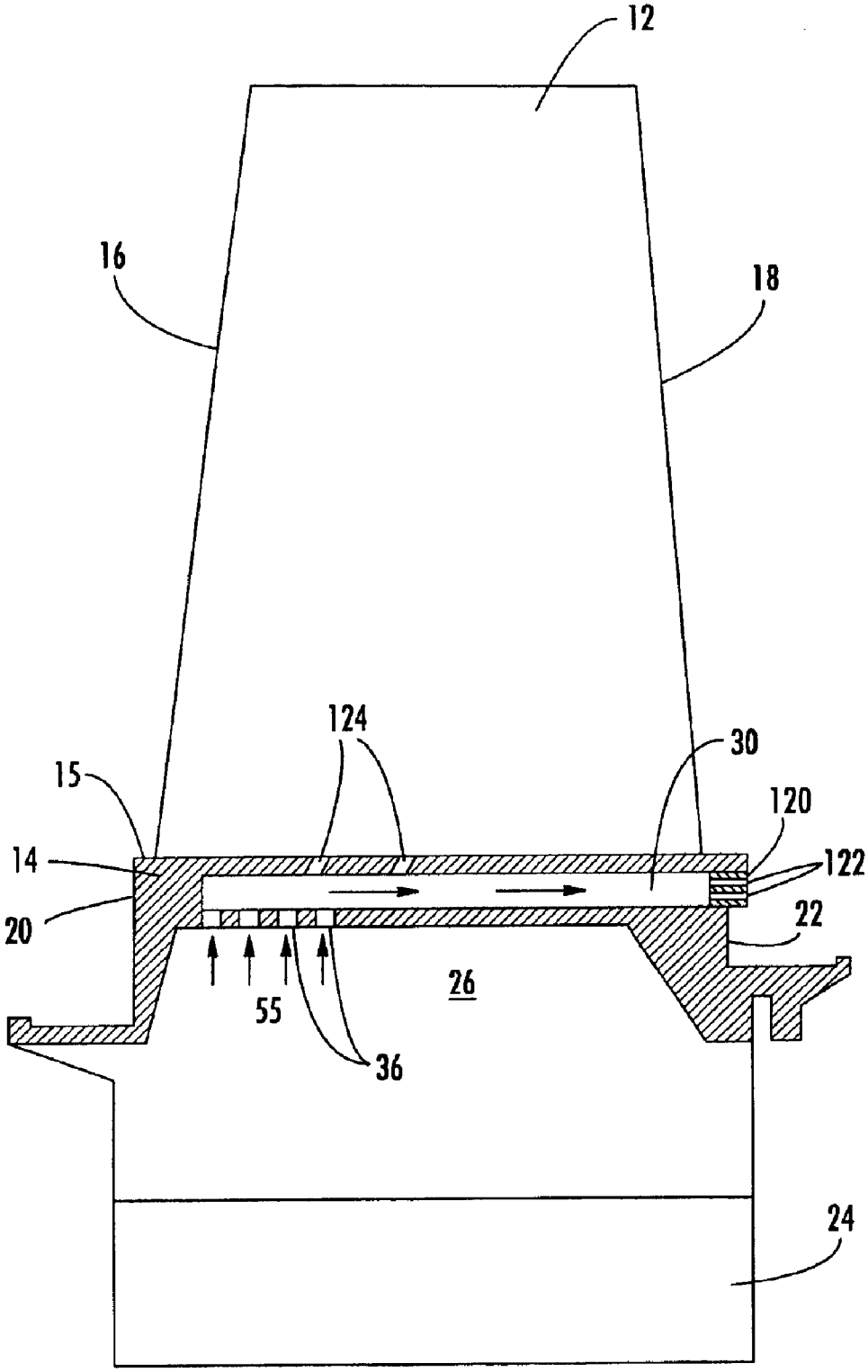
FIG. 8 is a cross-sectional view of a turbine blade assembly showing an alternative cooling system according to aspects of the present invention.

Instead of discharging through the side walls 40,42 of the platform 14, openings 124 can be provided so that coolant discharges through other portions of the platform 14. For example, as shown in FIG. 8, coolant can be discharged through the top surface 15 of the platform 14. Thus, one or more passages 124 can be provided in the platform 14 that extend between at least one of the channels 30 and the top surface 15 of the platform 14. Because of the flow restriction imposed by the cover 120, a portion of the coolant flow will be diverted through the passages 124.

The passages 124 can be oriented at almost any angle relative to the channel 30 or the top surface 15 of the platform 14. For example, the passages 124 can be oriented at substantially right angles to the channel 30 or the top surface 15 of the platform 14. However, it is preferred if the passages 124 are not oriented at substantially right angles with respect to the channel 30 or the top surface 15 of the platform 14 so as to gain the additional advantage of film cooling. In one instance, the passages 124 are located at about 60 degrees relative to the channel 30 or the top surface 15 of the platform 14.

The addition of the one or more channels 30 and the cooling holes 36 to the platform 14 allows for impingement cooling of the platform 14. The channels provide convection cooling to the platform 14. Moreover, the channels 30 can create localized regions of reduced thickness so as to reduce the stiffness of the platform 14, which in turn can reduce thermal stress. Because of the enhanced cooling and reduction in thermal stress, a turbine blade platform 14 according to aspects of the invention can have improved fatigue life.

Having described the individual components and features according to aspects of the present invention, one illustrative manner in which aspects of the invention can be provided in a turbine blade will now be described. The following description merely provides examples of processes that can be used to create a blade platform according to aspects of the invention.

The basic turbine blade assembly 10 can be a cast part. Therefore, in one embodiment, the one or more channels 30 can be cast into the platform 14 as well. Casting can be accomplished by creating a ceramic core that in placed in a wax tool. Once the wax mold is created, it can be dipped in ceramic to form a shell. The shell can be used to hold the platform channel core in place during casting. Support pins can be inserted through the platform, as needed, to stabilize the ends of the channel core.

Further, the channels 30 can be machined in the platform 14 by any of a number of processes. For example, the channels 30 can be machined by either electro-discharge machining (EDM) or electro-chemical machining (ECM). Alternatively, the channels 30 can be formed using conventional machining operations such as milling, drilling or waterjet cut. Regardless of the specific method used, material can be removed from the platform 14 beginning at the trailing edge face 22 and extending to the desired depth in the platform 14.

Another method for making the channels 30 is to machine the channels 30 from the trailing edge face 22 of the platform 14 through the leading edge face 20 of the platform 14. In a subsequent step, the opening at the leading edge face 20 can be substantially sealed by welding a plug inside of the opening or by securing a plate outside of the opening. While possible, such a method is not preferred because it increases the number of parts to the assembly, requires secondary assembly operations, and any welding may introduce undesirable distortions to the material or deposits to the channels 30. Alternatively, each channel 30 can be machined from the adjacent side wall 40,42 of the platform 14. A plate (not shown) can then be inserted and secured to the platform, such as by welding, so as to form one side of the channel 30.

Like the channels 30, the cooling holes 36 can be machined in the platform by any of the above described processes. For example, the cooling holes 36 can be added to the platform 14 using ECM or EDM operations.

The passages 110 (FIG. 7) and the passages 124 (FIG. 8) can be machined or cast into the platform 14. Similarly, the cover 100 (FIGS. 6–7) and the cover 120 (FIG. 8) can be formed by machining or casting. The cover 100,120 can be attached to the platform 14 by any suitable method such as welded, brazed, adhered, fasteners, or interference fit.

In the embodiment shown in FIG. 6, the additional channel 106 can be added by any of the methods discussed above in connection with the channel 30. Further, the passage 104 can be cast or drilled from the side wall of the platform 14 so as to connect channel 30 to channel 106. In a subsequent step, the opening of the passage 104 at the side 42 of the platform 14 can be substantially sealed by welding a plug 108 inside of the opening or by securing a plate outside of the opening.

Having described the cooling system according to aspects of the invention and various manners in which such aspects can be formed in a turbine blade platform, an example of the operation of a turbine blade configured according to aspects of the invention will be described below. Naturally, aspects of the present invention can be employed with respect to myriad blade designs as one skilled in the art would appreciate.

The cooling system according to aspects of the invention takes advantage of pressure differentials acting on the blade assembly 10. Specifically, the pressure in the shank portion 26 of the blade assembly 10 can be greater than the pressure at the trailing edge face 22 of the blade platform 14.

Figure 9:
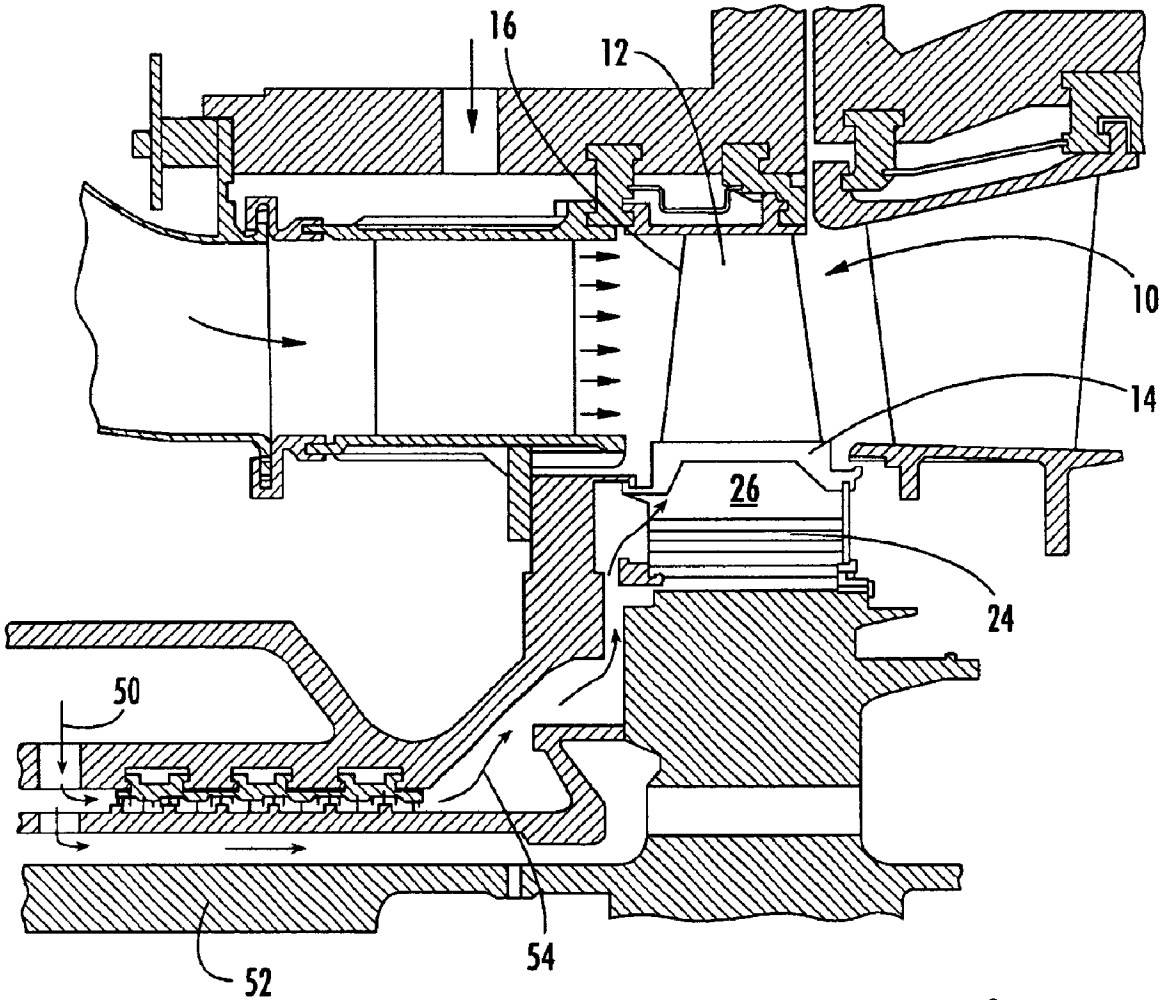
FIG. 9 is a cross-sectional view through the turbine section of a turbine engine, showing the flow of the cooling air into the shank that creates a relatively high pressure.

The relatively high pressure in the shank portion 26 is as result of supplying a coolant to the shank portion 26 of the blade assembly 10. Because turbine blades operate in the high temperature environment of the turbine, coolant must be supplied to the turbine blade assembly 10 as well as other components of the turbine section. In one cooling scheme, as shown in FIG. 9, involves supplying cooling air 50 to the rotor 52. A portion 54 of the rotor cooling air 50 can be routed to the shank portion 26 of the blade assembly 10. This is just one manner in which a coolant, such as air, can be supplied to the shank portion 26 of the blade assembly 10. Regardless of the source, the supply of coolant to the hollow cavity of the shank 26 raises the pressure in the shank 26 that exceeds the low pressure zones experienced at the trailing edge face 22 of the blade platform 14.

Figure 3:
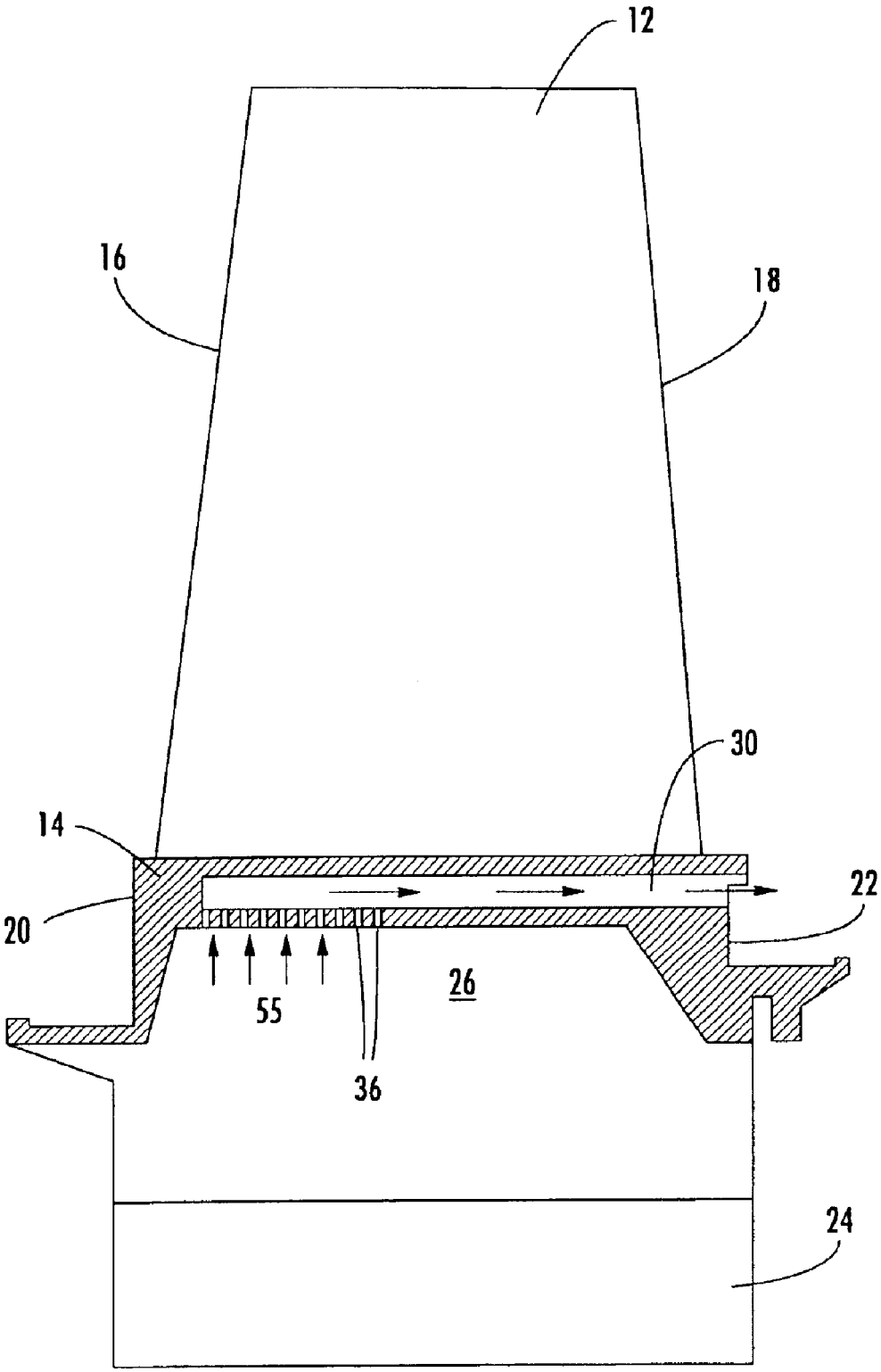
FIG. 3 is a cross-sectional view of a turbine blade assembly, taken along line 3—3 in FIG. 1, having a cooling system according to aspects of the present invention.

A cooling path according to aspects of the invention is shown in FIG. 3. A coolant 55 enters the shank portion 26 of the blade assembly 10 area. The above described pressure differentials induce coolant flow through the cooling holes 36 and into the channel 30. As it enters the channels 30, the coolant will first impinge on the top surface 30*a* of the channels 30 so as to provide impingement cooling. After that, the coolant can flow toward the low pressure zone at the trailing edge face 22 of the platform 14. Coolant exiting the channel 30 joins the rest of the gas flowing through the turbine.

As noted earlier, one cooling system according to aspects of the invention can include one or more branch channels 32 (FIG. 5) off of the channel 30 so as to cool other portions of the platform 14 such as, for example, the trailing edge face 22. In such case, a portion of the coolant flowing through channel 30 will be diverted into the branch channel 32. The branch channel 32 can further serve as a relief for any pressure buildup in the channel 30. Again, coolant can be dumped through the top 15 of the platform 14 near the trailing edge 22. Still other cooling systems are possible such as those shown in FIGS. 6–8 in which a plate 100 (FIGS. 6–7) or a plug (FIG. 8) can be used to restrict flow out of the channel 30. The resulting pressure buildup can be used to direct the coolant through other additional channels provided in the platform, as discussed earlier.

Aspects of the present invention are especially suited for upstream turbine blades, such as the first or second row or stage of blades, because of the relatively large pressure differentials between the shank portion and the trailing edge face of the platform for those blades. However, aspects of the invention can be applied to any row of blades. Aspects of the present invention can be employed with respect to myriad turbine blade designs as one skilled in the art would appreciate. Thus, it will of course be understood that the invention is not limited to the specific details described herein, which are given by way of example only, and that various modifications and alterations are possible within the scope of the invention as defined in the following claims.

What is claimed is:

1. A turbine blade assembly comprising:

a platform having a leading edge face, a trailing edge face, a first side and a second side;

an airfoil portion extending from the platform;

a hollow shank portion disposed beneath the platform;

a cooling channel extending through the platform beginning in an area near the leading edge face and extending through the trailing edge face of the platform, the cooling channel extending substantially proximate to the first side of the platform; and a plurality of longitudinally-spaced cooling holes extending between the hollow shank portion and the cooling channel, wherein the cooling holes are oriented substantially transverse to the cooling channel and adapted to admit impingement cooling fluid into at least a portion of said cooling channel.

2. The blade assembly of claim 1 wherein the cooling channel is substantially oval shaped.

3. The blade assembly of claim 1 wherein the cooling channel is substantially oblong shaped.

4. The blade assembly of claim 1 wherein the cooling channel has substantially rounded corners.

5. The blade assembly of claim 1 wherein the cooling channel includes an upper wall and a lower wall, wherein the upper and lower walls are substantially flat.

6. The blade assembly of claim 5 wherein the upper and lower walls are substantially parallel.

7. The blade assembly of claim 1 wherein the cooling holes are substantially circular in cross-section.

8. The blade assembly of claim 1 further comprising a second cooling channel extending through the platform beginning in an area near the leading edge face and extending through the trailing edge face of the platform, the second channel extending substantially proximate to the second side of the platform; and a plurality of longitudinally-spaced cooling holes extending between the hollow shank portion and the second cooling channel, wherein the cooling holes are oriented substantially transverse to the second cooling channel and adapted to admit impingement cooling fluid into at least a portion of said second cooling channel.

9. A turbine blade assembly comprising:

a platform having a leading edge face, a trailing edge face, a first side and a second side;

an airfoil portion extending from the platform;

a hollow shank portion disposed beneath the platform;

a cooling channel extending through the platform beginning in an area near the leading edge face and extending through the trailing edge face of the platform, the cooling channel extending substantially proximate to the first side of the platform; and a plurality of cooling holes extending between the hollow shank portion and the cooling channel, wherein the cooling holes are oriented substantially transverse to the cooling channel; and a branch channel in fluid communication with the cooling channel, the branch channel including an edge segment and an exhaust segment, wherein the edge segment extends substantially proximately along at least a portion of the trailing edge face of the platform.

10. The blade assembly of claim 9 wherein the platform includes a top surface, and the exhaust segment extends upward from the edge segment and through the top surface of the platform.

11. The blade assembly of claim 9 wherein the cooling channel is partially restricted by a cover.

12. The blade assembly of claim 11 wherein the cover is one of a plate or a plug.

13. The blade assembly of claim 11 further comprising an additional channel, the cooling channel and the additional channel being in fluid communication, wherein the additional channel is disposed between the cooling channel and the first side of the platform.

14. The blade assembly of claim 11 further comprising one or more passages extending between the cooling channel and one of the sides of the platform.

15. The blade assembly of claim 11 further comprising one or more passages extending between the cooling channel and the top surface of the platform.

16. A turbine blade assembly comprising:

a platform having a leading edge face, a trailing edge face, a first side and a second side;

an airfoil portion extending from the platform;

a hollow shank portion disposed beneath the platform;

a first cooling channel extending through the platform beginning in an area near the leading edge face and extending through the trailing edge face of the platform, the first cooling channel extending substantially proximate to the first side of the platform;

a second cooling channel extending through the platform beginning in an area near the leading edge face and extending through the trailing edge face of the platform, the second cooling channel extending substantially proximate to the second side of the platform, wherein each of the cooling channels is defined by a substantially flat top surface and substantially flat bottom surface and two curved side walls connecting between the top and bottom surfaces, the top and bottom surfaces being substantially parallel to each other; and a first set of longitudinally-spaced cooling holes extending between the hollow shank portion and the bottom surface of the first cooling channel, a second set of longitudinally-spaced cooling holes extending between the hollow shank portion and the bottom surface of the second cooling channel, wherein the first and second cooling holes are oriented substantially transverse to the first and second cooling channels and adapted to admit impingement cooling fluid into at least a portion of said first and second cooling channels.

* * * * *